United States Patent [19]

Thiemann et al.

[11] 3,992,947

[45] Nov. 23, 1976

[54] PIPETTING DEVICE

[75] Inventors: Wolfram Thiemann; Erich A. Heide, both of Julich, Germany

[73] Assignee: Kernforschungsanlage Julich Gesellschaft mit beschrankter Haftung, Julich, Germany

[22] Filed: Dec. 23, 1974

[21] Appl. No.: 536,928

[30] Foreign Application Priority Data

Dec. 21, 1973 Germany ..... 2363826

[52] U.S. Cl. ..... 73/421 R; 73/425.6

[51] Int. Cl.[2] ..... B01L 3/02

[58] Field of Search ..... 73/425.4 P, 425.6; 23/259

[56] References Cited

UNITED STATES PATENTS

| | | | |
|---|---|---|---|
| 2,153,105 | 4/1939 | Szecsi | 23/259 |
| 2,624,656 | 1/1953 | Andrews | 23/259 |
| 3,033,656 | 5/1962 | Saifer et al. | 23/259 |
| 3,145,876 | 8/1964 | McBrien | 23/259 |

*Primary Examiner*—S. Clement Swisher
*Attorney, Agent, or Firm*—Walter Becker

[57] ABSTRACT

A pipetting device in which one or more pipets for drawing in pipetting substance are connectible to a suction line connected to an underpressure chamber which has associated therewith a pressure controlling control valve, and in which the pipet or pipets for purposes of rinsing the pipetting material are adapted to be connected to a rinsing line connected to a container adapted to receive rinsing fluid, said rinsing container having associated therewith a rinsing fluid control valve. As underpressure chamber there is provided a liquid receiving chamber equipped with a discharge faucet, and between the container receiving rinsing fluid on one hand and the rinsing fluid control valve on the other hand there is provided a dosing device connected to the rinsing line for setting a selected quantity of rinsing fluid. For purposes of emptying the pipet or pipets the device is provided with a pressure gas conduit which through a pressure gas valve is connectible to the pipet or pipets.

3 Claims, 1 Drawing Figure

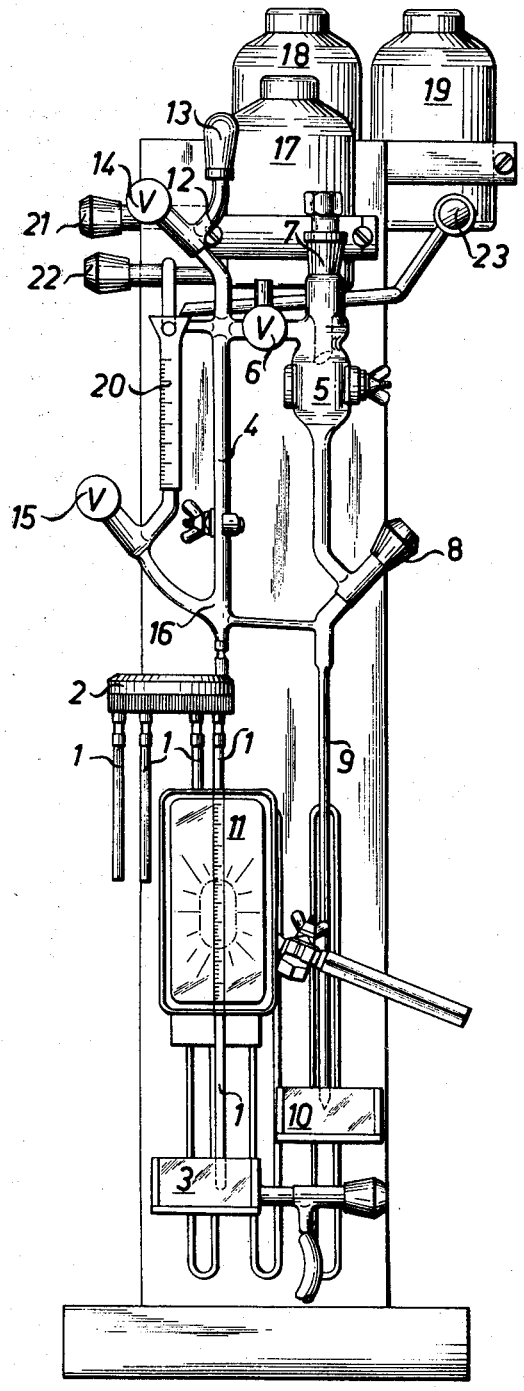
18
19
13
17
14
12
21
7
23
22
V
6
20
5
4
15
8
16
2
1
1
1
9
11
1
10
3

PIPETTING DEVICE

The present invention relates to a pipetting device in which one or more pipets are for purposes of drawing in pipetting material connectible to a suction line which is connected to an underpressure chamber while the latter comprises a control valve for controlling the pressure. More specifically, the invention relates to a pipetting device in which the pipet or pipets for rinsing the pipetting material is or are connectible to a conduit for conveying rinsing material which conduit has provided therein a valve for controlling the rinsing fluid and is connected to a reservoir containing rinsing substances.

Pipetting devices of this type are in particular useful for carrying out the checking of radioactive substances and of toxic or infectious substances. In this connection it is important that the quantity to be checked of the pipetting material drawn into the pipet can again be completely removed from the pipet. This requirement is important not only in order to be able to obtain precise measurements, but is also of importance for the protection of the servicing personnel. Under no circumstances must the servicing personnel get into direct contact with the materials or substances to the investigated.

A pipetting device has become known in which the drawing in of pipetting material is carried out by means of a remote controllable metering pump with pneumatically movable piston. By correspondingly adjusting the piston stroke, the drawn in quantity of the pipetting material can be varied. For the rinsing operation, the metering pump is provided with a connection for rinsing fluid conveying conduit and a valve for shutting off the conduit for rinsing fluid. The rinsing control valve is opened in conformity with the position of the piston after the major portion of the pipetting material has been discharged from the pipet by a corresponding movement of the piston. This device has the drawback that the quantity of rinsing fluid employed for rinsing the pipet cannot be dosed or metered. If the quality of the investigation has to meet a high standard, a precise setting of the quantity of rinsing fluid which thins the pipetting material is, however, necessary. A further drawback of the just mentioned device consists in that the metering pump which brings about the drawing in of the pipetting material has slideably movable pistons while considerable difficulties are encountered in sealing said pistons relative to its immediate environment. This fact brings about undesired operational disorders. When investigating radioactive substances or toxic or infectious substances, these difficulties in connection with the sealing must already for reasons of safety not be considered negligible.

It is, therefore, an object of the present invention to provide a pipetting device for radioactive materials or toxic or infectious substances which, on one hand will safeguard the servicing personnel against contact with the substances to be investigated and on the other hand will while assuring a disorder-free operation furnish measuring results which will meet high requirements as to precision of said results and as to the possibility of reproducing the measuring results. These and other objects and advantages of the invention will appear more clearly from the following specification in connection with the accompanying drawing illustrating a pipetting device according to the invention.

The pipetting device according to the present invention is characterized primarily by the following features:

a. as underpressure chamber there is provided a liquid receiving chamber equipped with an outlet faucet;

b. between the reservoir for the rinsing substance and the valve for controlling the rinsing fluid there is interposed a dosing or metering device for a predetermined quantity of rinsing fluid, said dosing or metering device being connected to a conduit for conveying rinsing fluid;

c. for purposes of emptying the pipet or pipets there is provided a compressed gas conveying conduit which through a pressure gas valve can be connected with the pipet or pipets.

The pipetting device according to the invention does substantially without slidingly movable parts. The liability to disorders of the device is thus limited to a minimum. For drawing in the pipetting material, there is provided a chamber which is filled with a liquid and by means of which the necessary underpressure for drawing in the pipetting material is generated in a most simple manner by discharging liquid. The discharge faucet arranged on the liquid containing chamber permits a corresponding control of the level of the liquid so that the desired quantity of pipetting material which is to be drawn in by the pipet can be precisely adjusted. For purposes of ejecting or discharging the pipetting materials, the pipet is connected to a pressure gas conveying conduit. Subsequently the pipet is rinsed. In this connection it is advantageous that the quantity of rinsing substance which is intended to receive the remaining pipetting material still left in the pipet can be so measured by means of said dosing or metering device that after the rinsing operation a predetermined thinning degree will be obtained which is in conformity with the investigation or tests of the pipetting material. By means of the pipetting device according to the invention, the above mentioned investigations or checks of the pipetting material can be carried out at high precision and the measuring results can be precisely reproduced. The pipetting device according to the invention due to its design will additionally assure a sufficient protection of the servicing personnel in conformity with safety laws and correspondingly protect the personnel against contact with radioactive, toxic or infectious material to be checked.

The necessary rinsing means are selected in conformity with the property of the pipetting material. During the investigation or checking of radioactive material, decontaminating solutions are employed. When checking infectious or toxic substances, sterilizing or disinfecting liquids are employed. When checking infectious or toxic substances, sterilizing or disinfecting liquids are employed. By selecting the concentration or quantity of the rinsing substance, care can be taken that the pipet and the pipetting material will after the removal of the pipetting material be so cleaned that a danger for the health of the servicing personnel will be excluded.

Referring now to the drawing in detail, for purposes of receiving a greater number of different pipets 1, a pipet holder 2 in the form of a turret head is mounted on the pipetting device. The pipet 1 required for the respective check of the pipetting material in a bowl 3 containing pipetting material is at its upper end connected to a suction line 4 which in its turn communicates with a liquid containing or under pressure chamber 5. A shut-off valve 6 is interposted in the intake line 4. The fluid chamber 5 is through an inlet connection 7 filled with liquid. For discharging the liquid and for generating the necessary underpressure for drawing in the pipetting material, an outlet faucet 8 is provided at the outlet of the liquid chamber 5. The outlet faucet 8 permits a very fine control of the liquid level in the liquid chamber 5 so that the drawn-in quantity of pipetting material can be precisely adjusted. The liquid discharged or released from the liquid chamber 5 flows through a discharge passage 9 into a collecting container 10. The drawn-in quantity of pipetting material can be read on a gauged scale provided on a gauged scale provided on a pipet wall. An illuminated magnifying glass 11 which is displaceable along the pipet scale facilitates the adjustment of the volume. The drawn-in quantity of pipetting material is therefore adjustable in a very precise manner.

For purposes of emptying the pipet into a reaction vessel which is not shown in the drawing, a pressure gas conduit 12 connected to a gas pump leads into the suction line 4. In the specific embodiment shown in the drawing, as gas pump, for purposes of simplification, an air pump has been inserted with a manually operable rubber ball 13. Depending on the respective technical requirements, however, also other gas pumps known in the art may be employed by opening a pressure gas valve 14 interposed in the pressure gas conduit 12. The pressure gas is introduced into the suction line 4. During the emptying operation, the shut-off valve 6 remains closed in the intake line 4.

Expediently, the pressure gas valve 14 is so designed that also by means of a fine sensitive control and a slow release of the pipetting material in the pipet 1, the quantity of pipetting material can be precisely adjusted.

In order to be able completely to transfer the measured quantity of pipetting material received from pipet 1 into the reaction vessel, a rinsing fluid conveying conduit 16 is in communication with the suction line 4, said conduit 16 being adapted to be closed by a rinsing valve 15. In the particular embodiment shown, as rinsing means there are available three different rinsing liquids which are kept as supply in containers 17, 18 and 19 respectively. Depending on the material to be investigated, the pipet 1 may be rinsed with a solution for decontamination, sterilization, or disinfection.

The precise determination of the quantity of rinsing fluid provided for the rinsing of the pipet 1 is effected by a dosing device. Expediently, the dosing device consists of a dosing container 20, the container wall of which has a gauge scale for indicating the quantity of rinsing substance which has been filled into the glass container, and also comprises dosing faucets 21, 22, 23 arranged on the container 17, 18 and 19 for the rinsing fluid. By means of said dosing faucets it is possible to adjust the withdrawing speed of the respective required rinsing fluid to such small speeds that the quantity of rinsing fluid received by the dosing container 20 can be precisely metered. In this way the thinning of the pipetting material which enters after the rinsing of the pipet can be very precisely determined.

The construction of the pipetting device is suitable not only for the operation referred to in the embodiment but is also particularly advantageous for the device when an automatic operation is desired.

It is, of course, to be understood that the present invention is, by no means, limited to the specific showing in the drawings but also comprises any modifications within the scope of the appended claims.

What we claim is:

1. A pipetting device which includes in combination: an underpressure chamber, suction conduit means connected to said undepressure chamber, at least one pipet being connectible to said suction conduit means for withdrawing different quantities of pipetting substance, control valve means associated with said underpressure chamber for variably controlling the pressure therein, rinsing fluid receiving chamber means, a rinsing fluid valve associated with said rinsing fluid receiving chamber means for controlling the flow of rinsing fluid from said rinsing fluid receiving chamber means, rinsing fluid conduit means connected to said rinsing fluid receiving chamber means, said pipets being connectible to said rinsing conduit means, and said underpressure chamber including a liquid chamber with a discharge faucet, a dosing device connected to said rinsing fluid conduit means and arranged between said rinsing fluid control valve and said rinsing fluid receiving container for setting the release of a selected quantity of rinsing fluid, and a pressure valve associated with said gas under pressure relative to conveying conduit means for emptying said pipet.

2. A device in combination according to claim 1, which includes three rinsing fluid receiving chambers for respectively receiving solutions for decontaminating, sterilizing and disinfecting.

3. A device in combination according to claim 1, which includes a turret head operable to receive and hold a plurality of pipets.

* * * * *